US006341450B1

(12) United States Patent
Macander et al.

(10) Patent No.: US 6,341,450 B1
(45) Date of Patent: Jan. 29, 2002

(54) COMPOSITE WATER-TIGHT DOOR PANEL INSTALLATION

(75) Inventors: Aleksander B. Macander, Rockville, MD (US); Robert F. Charette, Gaithersburg, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/599,597

(22) Filed: Jun. 22, 2000

(51) Int. Cl.[7] ..... E02D 29/14

(52) U.S. Cl. ..... 52/20; 49/278; 49/395; 114/117; 114/201 R; 292/340

(58) Field of Search ..... 52/213, 19, 20; 49/278, 395; 114/116, 201 R, 203, 117; 292/340, 341.11, 341.13

(56) References Cited

U.S. PATENT DOCUMENTS 2,762,473 A * 9/1956 Swerdlow ..... 49/395 X
5,283,979 A * 2/1994 Carlson et al. ..... 49/395
5,676,082 A * 10/1997 Kyle ..... 114/201 R
5,758,593 A * 6/1998 Kyle ..... 114/114 R X
6,003,461 A * 12/1999 Banchette et al. ..... 114/117

* cited by examiner

*Primary Examiner*—David M. Purol
(74) *Attorney, Agent, or Firm*—Jacob Shuster

(57) ABSTRACT

A light-weight door panel flush with the external surface of a wall structure in its closed position sealing an opening, is mounted for displacement to an open position by hinge linkage confined to its underside. In its closed position supported on the bulkhead of the door frame bordering the opening in the wall structure, the door panel compresses a sealing gasket bonded to the bulkhead. Such compression of the gasket by the door panel is established and maintained through selectively controlled rolling pins engaged with wedges resiliently held within corrosion resistant inserts bonded to the door panel at spaced peripheral locations therein.

7 Claims, 3 Drawing Sheets

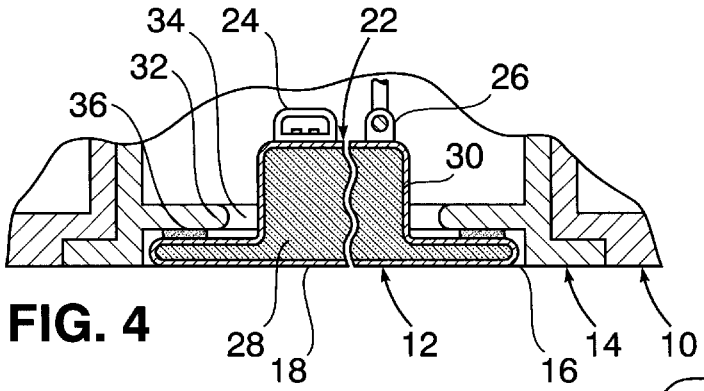
FIG. 4
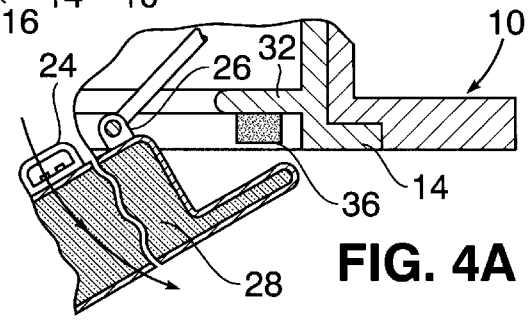
FIG. 4A
FIG. 5
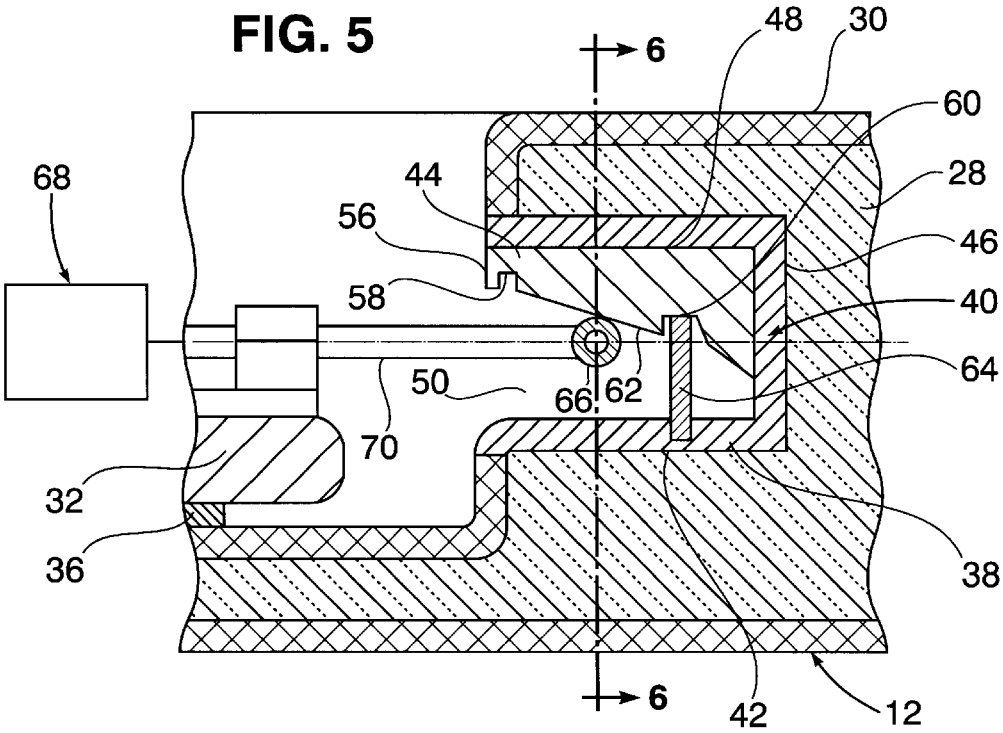

COMPOSITE WATER-TIGHT DOOR PANEL INSTALLATION

The present invention relates generally to a door panel and installation thereof for water-tight closure of an opening in a wall structure of an enclosure such as a marine vessel.

BACKGROUND OF THE INVENTION

Door closure of openings in certain installations, such as a marine vessel, require water-tight sealage. Existing door panel closures on marine vessels are often inadequate so as to require frequent maintenance and/or replacement to provide the necessary water-tightness. It is therefore an important object of the present invention to provide a door panel and associated installational arrangement in the foregoing type of environment which would avoid and/or overcome water leakage problems heretofore associated therewith, involving vibratory loading, wear and distortion of parts and heavy door weight imposing excessive handling burdens on personnel.

SUMMARY OF THE INVENTION

In accordance with the present invention, a door panel is provided having an external surface that is flush in its closed position with the external surface of an associated wall structure, such as the topside of a marine vessel or ship. Water-tight sealage of an opening in such wall structure is effected by compression of a foam gasket adhesively fastened to a recessed bulkhead portion of a door frame on which the door panel is supported in its closed position. The door panel is displaced between such closed position and an open position through hinge linkage excluded from any external portion of the door panel by confinement to an internally raised portion thereof projecting into the door frame opening. At peripherally spaced locations in such internally raised portion of the door panel, corrosion resistant insert assemblies are retained by adhesive bondage for reception of rolling pins of a selectively controlled actuator mechanism to establish and maintain the water-tightness compressive engagement of the sealing gasket on the recessed bulkhead of the door frame by the door panel in the closed position. Replaceable wedge elements are resiliently held within each of the insert assemblies for engagement by the rolling pins with a tolerated degree of misalignment during maintenance of the water-tight sealing condition. In concert with the latter installational arrangement, a compliant, light-weight construction is utilized for the door panel, consisting of a balsa wood core enclosed within a reinforced plastic skin.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 4 is a partial enlarged section view taken substantially through a plane indicated by section line 4—4 in FIG. 3, showing the door panel in the closed position;

FIG. 4A is a partial section view similar to that of FIG. 4, showing the door panel in an open position;

FIG. 5 is an enlarged partial section view taken substantially through a plane indicated by section line 5—5 in FIG. 3;

DETAILED DESCRIPTION OF PREFERRED EMBODIMENT

Figure 1:
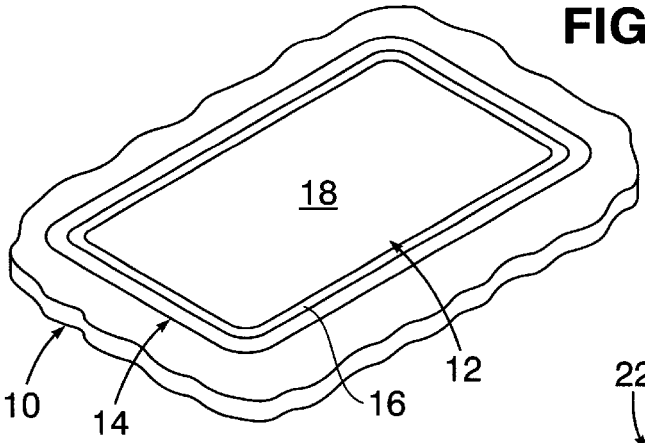
FIG. 1 a perspective view of a portion of a marine vessel wall structure as an installational environment for a door panel in a closed position.

Referring now to the drawing in detail, FIG. 1 shows a topside portion of a marine vessel wall structure 10 having an opening therein sealed by a door panel 12 in a closed position. Such opening is bordered by a peripheral frame 14 supporting the door panel 12 with an outer gap 16 thereabout in its closed position, exposing a flat surface portion 18 thereof in alignment or flush with the outer surface of the wall structure 10.

Figure 2:
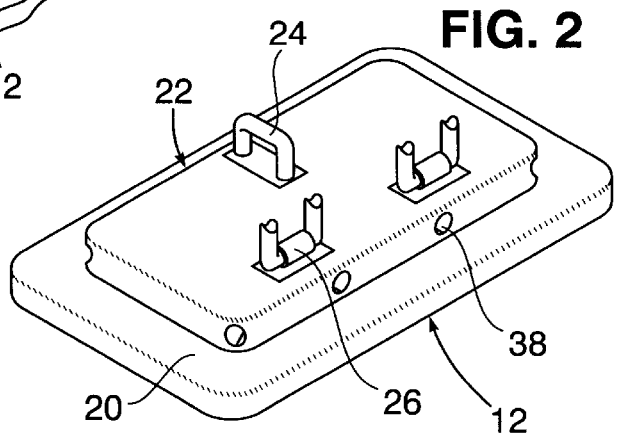
FIG. 2 is a perspective underside view of the door panel per se shown in FIG. 1, illustrating a construction in accordance with the present invention.
Figure 3:
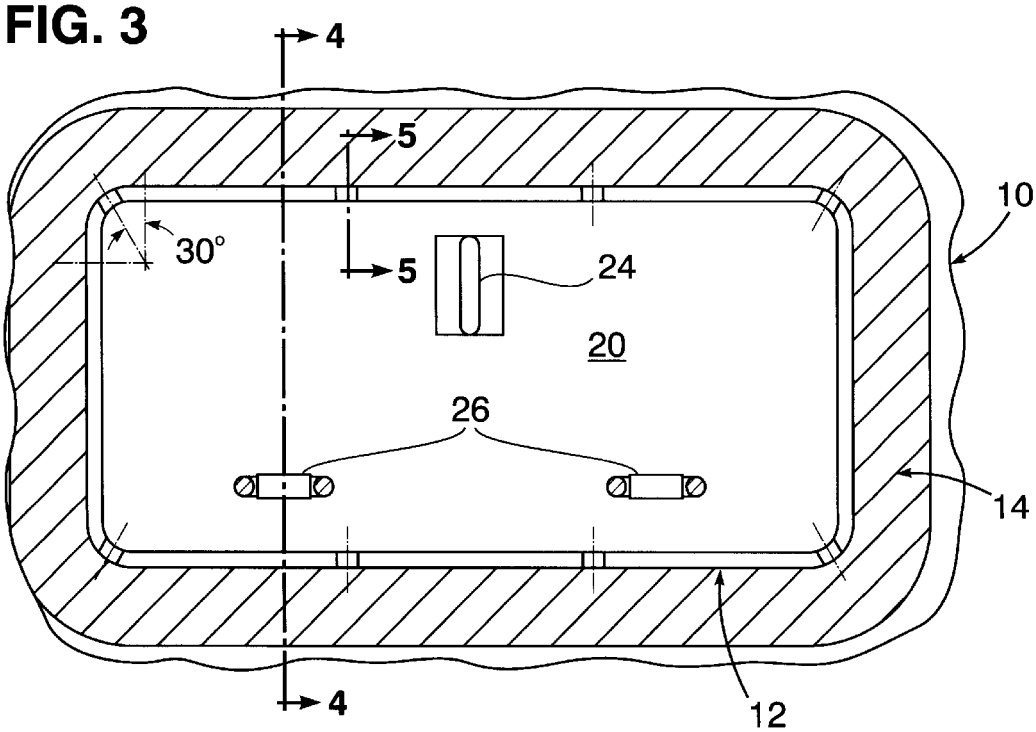
FIG. 3 is an underside plan view of the door panel in the installational arrangement shown in FIG. 1.

As shown in FIGS. 2 and 3, the door panel which is generally rectangular in shape has an underside surface 20 from which an inner raised portion 22 projects and on which a grab handle 24 is mounted intermediate opposite end sides thereof in spaced adjacency to one longitudinal side thereof. Also, mounted on such raised underside portion 22 in spaced adjacency to its other longitudinal side are a pair of door hinges 26.

Referring now to FIG. 4, the door panel 12 has a balsa wood core 28 fully enclosed within an outer casing skin 30 made of a glass reinforced plastic material of adequate strength and stiffness, such as a woven roving, to form a lightweight sandwich construction. In the closed position of such door panel 12, it is held in sealed relation on the door frame 14 over a recessed bulkhead portion 32 thereof forming an opening 34 through which the underside raised portion 22 of the door panel 12 projects. A peripheral sealing gasket 36 is positioned on such recessed bulkhead portion 32 of the door frame 14 and is bonded thereto for engagement with and compression by the door panel 12 in its closed position to seal the opening in the vessel wall structure 10 in a water-tight manner. As shown in FIG. 4A, the door panel 12 may be angularly displaced to an open position from its closed position by force exerted thereon through the handle 24. Such angular displacement relative to the wall structure 10 of a vessel enclosure may be accommodated through the hinges 26 and any suitable internal supporting hardware attached to the vessel.

Figure 6:
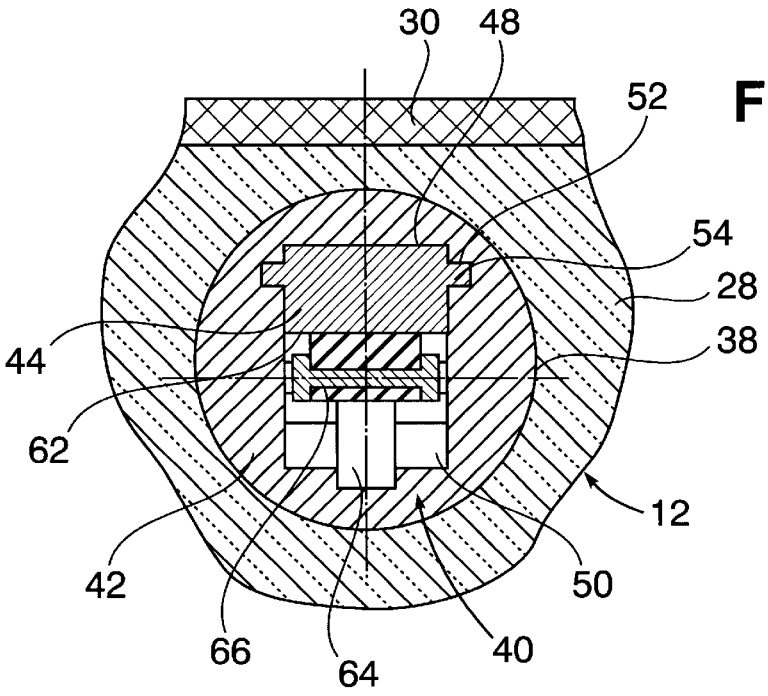
FIG. 6 is a partial section view taken substantially through a plane indicated by section 6—6 in FIG. 5.
Figure 7:
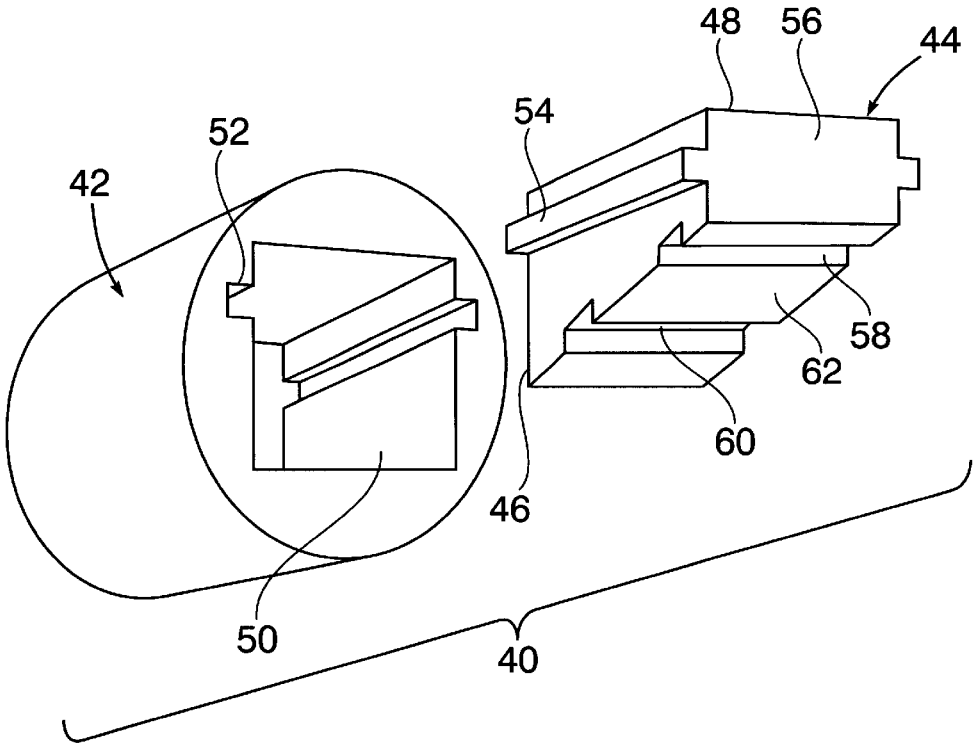
FIG. 7 is a perspective view of disassembled portions of the insert assembly shown in FIGS. 5 and 6.

In the embodiment shown in FIG. 2, the rectangular raised portion 22 of the door panel 12 has eight (8) spaced cylindrical pockets 38 formed therein at the corners and intermediate such corners. Each of such pockets 38 is adapted to receive a replaceable locking insert assembly 40, as shown in FIGS. 5, 6 and 7. The insert assembly 40 consists of an outer cylindrical body 42 made of corrosion resistant steel adhesively bonded to the core 28 of the door panel 12 and a wedge element 44 interfitted therein. At its larger rectangular end 46 and side 48 perpendicular thereto the wedge element 44 is in abutting contact with the cylindrical body 42 within a generally rectangular opening 50 formed therein. Grooves 52 formed in the cylindrical body 42 extend laterally from the opening 50 therein, as shown in FIGS. 6 and 7, for slidable reception of lateral projections 54 on the wedge element 44 which also has a smaller rectangular end 56 exposed from the opening 50 in the body 42 as shown in FIG. 5. A pair of lateral slots 58 and 60 are also formed in the side 62 of the wedge element 44 extending at a wedge angle to the other side 48. A cantilevered retention spring element 64 anchored to the cylindrical body 42 is received in the slot 60, as shown in FIG. 5, in order to yieldably resist movement of the wedge element 44 within the cylindrical body 42 after being captured in place therein by reception of the projections 54 within the grooves 52.

As also shown in FIGS. 5 and 6, the angled side 62 of each wedge element 44 is in contact with a retractable rolling pin 66 associated with a selectively controlled closure mechanism 68 within the vessel. Such rolling pin 66 is accordingly carried at the end of an actuator rod 70 slidably supported on the bulkhead portion 32 of the door frame 14 for displacement by the closure mechanism 68 as diagrammed in FIG. 5. The rolling pin 66 is thereby displaced to the locking position as shown in FIG. 5 after the door panel 12 is placed in its closed position, to effect and maintain water-tight sealing.

It will be apparent from the foregoing description that the door panel 12 is of a robust, light-weight construction which incorporates built-in locking facilities at the peripherally spaced locations of the pockets 38 formed therein, which accommodate facilitated detachment and replacement of the locking insert assemblies 40 after significant wear thereof. The configuration of such locking insert assemblies 40 is such as to tolerate a degree of misalignment of the rolling pins 66 during engagement to reduce maintenance concerns. Consistent therewith, the mounting location of the sealing gasket 36 on the bulkhead 32 prolongs water tightness. Further, the mounting locations of the door handle 24 and hinges 26 on the inside of the door panel 12 for displacement thereof between closed and open positions minimizes topside clutter and improves radar performance, Still further, the composite sandwich construction of the door panel 12 is such as to accommodate fabrication by any convenient low cost method involving for example a vacuum assisted resin infusion process.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an enclosure installation having a wall structure provided with an external surface within which an opening is formed bordered by a frame having a recessed bulkhead; a door panel having an external portion and an underside raised portion projecting therefrom; hinge means connecting the underside raised portion of the door panel to the wall structure for displacement of the door panel from an open position to a closed position with the external portion thereof flush with the external surface of the wall structure and with the underside portion projecting through the opening in the bulkhead; gasket means responsive to compression thereof on the bulkhead for sealing of the opening by the door panel while supported on the bulkhead in the closed position; and selectively controlled means for establishing and maintaining said compression of gasket means in the closed position of the door panel.

2. In combination with an enclosure installation having a wall structure provided with an external surface within which an opening is formed bordered by a frame having a recessed bulkhead; a door panel having an external portion and an underside raised portion projecting therefrom; hinge means connecting the underside raised portion of the door panel to the wall structure for displacement of the door panel from an open position to a closed position with the external portion thereof flush with the external surface of the wall structure and with the underside raised portion projecting through the opening; gasket means responsive to compression thereof on the bulkhead for sealing of the opening by the door panel while supported on the bulkhead in the closed position; and selectively controlled means for establishing and maintaining said compression of the gasket means in the closed position of the door panel; said selectively controlled means including: a plurality of wedges; means for replaceably mounting said wedges in peripherally spaced relation to each other in the door panel; and actuator means engageable with said wedges for exertion of compressive force on the gasket means.

3. The combination as defined in claim 2, wherein said replaceable mounting means comprises a plurality of insert bodies made of corrosion resistant material bonded to the door panel and within which the wedges are received; and spring means for resiliently holding said wedges within openings formed in the insert bodies.

4. The combination as defined in claim 3, wherein said door panel is formed from a balsa wood core enclosed within an outer skin of reinforced plastic.

5. In combination with an enclosure installation having a wall structure provided with an external surface within which an opening is formed bordered by a frame having a recessed bulkhead; a door panel formed from a balsa wood core enclosed within an outer skin of reinforced plastic, said door panel having an external portion and an underside raised portion projecting therefrom; hinge means connecting the underside raised portion of the door panel to the wall structure for displacement of the door panel from an open position to a closed position with the external portion thereof flush with the external surface of the wall structure and with the underside raised portion projecting through the opening; gasket means responsive to compression thereof on the bulkhead for sealing of the opening by the door panel while supported on the bulkhead in the closed position; and selectively controlled means for establishing and maintaining said compression of the gasket means in the closed position of the door panel.

6. In combination with an enclosure installation having a wall structure provided with an external surface within which an opening is formed bordered by a frame having a recessed bulkhead; a door panel formed from a balsa wood core enclosed within an outer skin of reinforced plastic; hinge means connecting the door panel to the wall structure for displacement between an open position and a closed position flush with the external surface of the wall structure; gasket means responsive to compression thereof on the bulkhead for sealing of the opening by the door panel while supported on the bulkhead in the closed position; and selectively, controlled means for establishing and maintaining said compression of the gasket means in the closed position of the door panel.

7. In combination with an enclosure installation having a wall structure provided with an external surface within which an opening is formed bordered by a frame having a recessed bulkhead; a door panel; hinge means connecting the door panel to the wall structure for displacement between an open position and a closed position flush with the external surface of the wall structure; gasket means responsive to compression thereof on the bulkhead for sealing of the opening by the door panel while supported on the bulkhead in the closed position; and selectively controlled means for establishing and maintaining said compression of the gasket means in the closed position of the door panel; said selectively controlled means including: a plurality of wedges; means for replaceably mounting said wedges in peripherally spaced relation to each other in the door panel; and actuator means engageable with said wedges for exertion of said compression on the gasket means.

* * * * *